United States Patent [19]

Zilver

[11] 4,073,331

[45] Feb. 14, 1978

[54] DEVICE FOR MAKING A CURTAIN HANG IN REGULAR PLEATS

[76] Inventor: Edwin Zilver, v. Beethovenlaan 115, Doorwerth, Netherlands

[21] Appl. No.: 665,558

[22] Filed: Mar. 10, 1976

[30] Foreign Application Priority Data

| | | |
|---|---|---|
| Mar. 6, 1976 | Netherlands | 7602237 |
| Mar. 13, 1975 | Netherlands | 7502979 |

[51] Int. Cl.[2] ..... A47H 13/14

[52] U.S. Cl. ..... 160/348

[58] Field of Search ..... 160/330, 348, 349

[56] References Cited

U.S. PATENT DOCUMENTS

| | | | |
|---|---|---|---|
| 359,896 | 3/1887 | Shinn et al. | 160/348 |
| 1,852,729 | 4/1932 | White | 160/348 |
| 2,167,651 | 8/1939 | Hess | 160/348 |
| 2,366,986 | 1/1945 | Siden | 160/348 |
| 3,090,431 | 5/1963 | Stubblefield | 160/348 |
| 3,259,151 | 7/1966 | Schmitz | 160/349 |
| 3,399,713 | 9/1968 | Wilson | 160/348 |
| 3,688,341 | 9/1972 | Peckham | 160/330 |

*Primary Examiner*—Peter M. Caun
*Attorney, Agent, or Firm*—Paul & Paul

[57] ABSTRACT

An oblong elastical zig-zag member to apply in the hem of a curtain in order to improve the pleat forming of the curtain, said member having sufficient elasticity to allow the curtain to be in the drawn back and the drawn position. Preferably the zig-zag member is of synthetic material and provided with means to connect it to suspension means or to another zig-zag member of the same type.

3 Claims, 9 Drawing Figures

DEVICE FOR MAKING A CURTAIN HANG IN REGULAR PLEATS

The invention relates to a device for making a curtain hang in regular pleats.

To make a curtain hang in regular pleats it has been usual up to now to sew in at the upper side of the curtain a means for making pleats, e.g. by every time doubling up a portion of the top border of the curtain and stitching the curtain in this position.

This course of things requires a lot of manual labour and moreover has the disadvantage that the pleats in the curtains are not well marked and often are not regular either. This holds in particular when curtains having a relatively large height are concerned.

The invention aims at providing a device for making curtains hang in pleats, which device requires less labour and causes the curtain to hang in pleats in a surprisingly better and aesthetically more attractive way than with the sewn-in additional piece of pleats as described above.

Accordingly, the invention provides a device for making a curtain hang in regular pleats, characterized by an oblong resilient member, said member being prebent zigzagly in such a way that it can be subjected to an elastical deformation between a first position, in which the ends of the zigzag portions are almost in engagement with each other and a second position, in which the distance between the ends of the oblong member is at least about half the length of said member.

It has appeared, that by inserting such a member into an upper hem of a curtain a well-defined pleat forming is obtained, which moreover gives a surprising and extremely attractive appearance.

With curtains it is common use that the length of the curtain measured along the hem by which it is hung, is about twice the length of the plane which has to be covered by the curtain. This gives an extremely beautiful pleat forming when applying the invention. When using the invention it is also possible to obtain an equivalent or even an improved aesthetical effect and to use less curtain material than is possible without the invention.

According to the preferred embodiment of the invention, the distance between the ends of the oblong member in the closed position of the curtain therefore is from 50 to 75% of the length of the member.

The said member can be carried out such, that it is in the first mentioned position when no force is exerted upon it. This means that, when no horizontal force is exerted upon the curtain, it is completely drawn back and can be housed on a minimum rail or rod length. If one wants to draw the curtains one can make the curtain spread itself by a cord as is well known per se. Because the member according to the invention is resilient, it is advisable to use therewith a toggle or cordbrake. Drawing back the curtain can then easily take place by releasing the brake. It is, however, also possible that the member, when no force is exerted upon it, is in the said second position. This can e.g. be the case when one prefers to keep the curtain shut, such as for curtaining off a cupboard or the like. In that case the curtain thus has to be held in the open position by making use of the toggle or cordbrake.

A preferred embodiment of the invention consists furthermore in that the member consists of straight portions with circular bent portions therebetween having a radius of curvature which is large in comparison with the thickness of the member at the location of the bent portion, and small relative to the length of the straight portions.

it has appeared that in this way without technological difficulties a member can be obtained which meets the requirement of being able to be subjected to an elastical deformation between the two said positions but which, when it is stretched, takes moreover a zigzag shape with almost straight portions connected to each other by circularly bent portions. This provides a very good pleat form.

Although in principle the oblong resilient member according to the invention can be made of any resilient material, synthetic material e.g. thermoplastic or thermosetting materials are preferred. For adaption to the elastical properties of the material it is further possible to give the oblong member at the location of the bendings between the relatively straight portions another thickness than the relatively straight portions themselves.

It has appeared that very good results can be obtained by using synthetic material, which has been cast (in case of thermoplastic material) or hardened out (in case of thermosetting material) in the bent shape. Synthetic materials avoid all corrosion problems, whereas further they allow to wash the curtain with the oblong member in the hem in warm water. With polypropylene e.g. a washing temperature of 60° C is allowable. Even some restoration of the original shape can occur, if this shape has been lost somewhat, e.g. by over-stressing.

Another possibility forms a bent strip of stainless steel, which at a high temperature is pre-bent to a zigzag-shape. When the member is in the first position said circular bendings will extend themselves over somewhat more than 180° such that successive bent portions will alternately engage each other.

The member can have various shapes. In addition to a flat thin strip also a wire with a circular cross-section can be used. Also a wickerwork e.g. of metal wire can be employed.

When the curtain has a lower hem and by this is relatively stiff at the lower side, a second resilient zigzag member can be provided in the lower hem. This shall, however, have very little rigidity, to make sure that the curtain in the drawn back position will not stand out at the lower side. In the lower hem in some cases a zigzag member can be provided with straight portions which are hingedly connected with each other. Of course, when using a member in the lower hem, the length of the zigzag portions must always correspond to that of the portions of the elastical member in the upper hem.

Hooks can be applied in the known way for suspending the device, which hooks will be suspended in runners, rings or the like, which are displaceable along a rail.

According to a preferred embodiment of the invention holes are provided in the oblong member, through which a mandrel of a suspension member can be inserted. Preferably, the holes are herewith provided with notches and the mandrels of the suspension members have a shaft section fitting into the holes and a thicker anchoring portion.

The holes can also be used to connect together two oblong members which are in line with each other. By this it is possible to come out with a standard length of the oblong members for curtains of any width.

In another embodiment of the invention the hooks are executed such, that they grip over the resilient member, for which purpose they are mainly U-shaped, one leg of the U being hooked.

Both these embodiments provide an extremely good mounting possibility, in that the oblong resilient member, by which the curtain is supported over its full length, is directly connected itself in many locations with the rail.

According to a preferred embodiment of the invention the oblong member is provided with embossments having a skirt portion and a top plane with a central hole. Slits may extend from this central hole to the skirt portion.

In order to join oblong members according to this preferred embodiment of the invention, they may be provided at one end with holes in which the embossments fit. It is not difficult to feel the embossments when the oblong member is in the hem of a curtain, so that a suspension member having mandrels easily can be connected to the oblong member by inserting the mandrels in the holes of the embossments.

The invention will now further be elucidated with reference to embodiments, shown in the accompanying drawings, in which.

Figure 1:
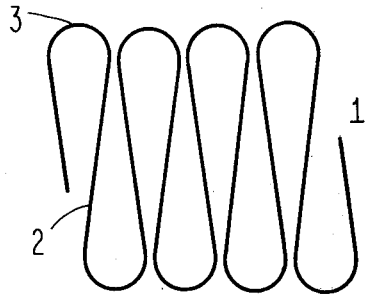
FIG. 1 shows a top view of a device according to the invention in a first position.
Figure 2:
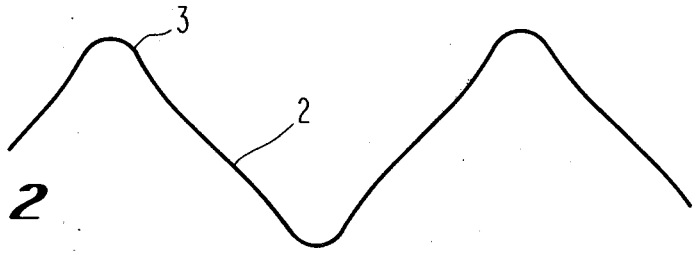
FIG. 2 shows the same device as FIG. 1 in a second position.
Figure 3:
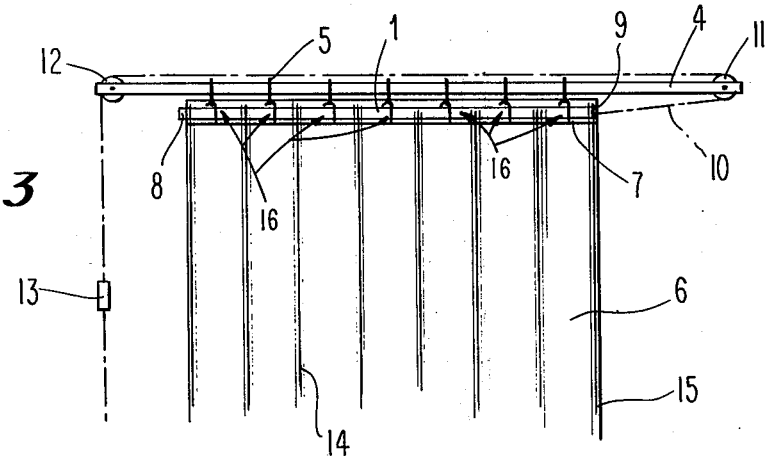
Figure 4:
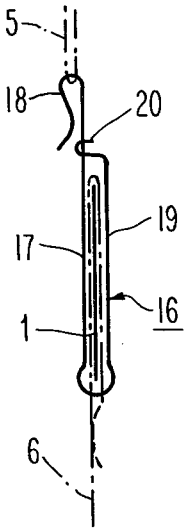
Figure 5:
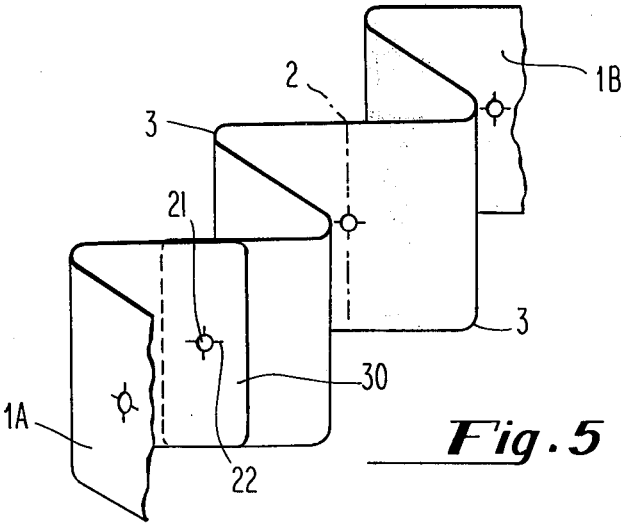
Figure 6:
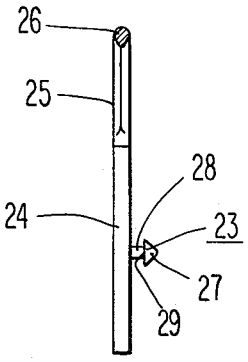
Figure 7:
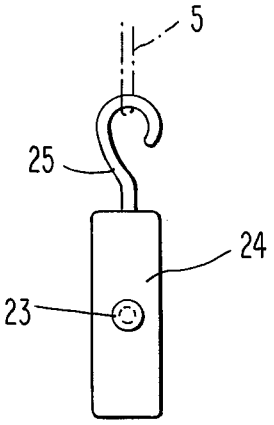
Figure 8:
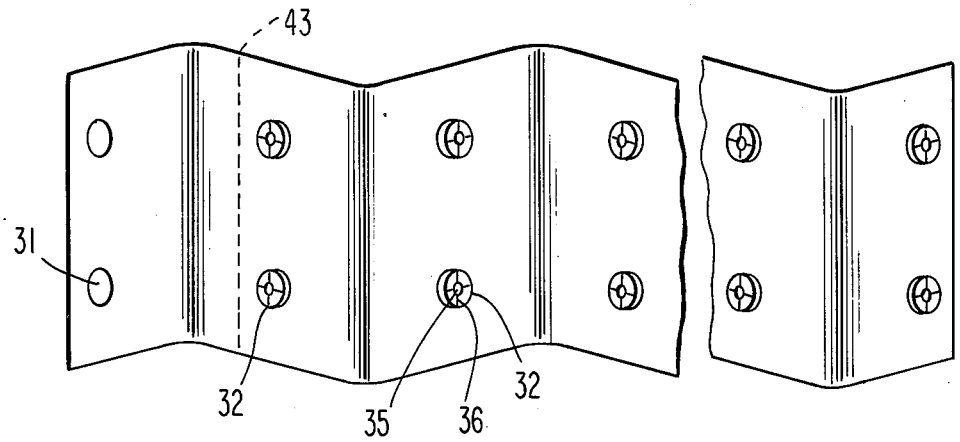

FIG. 3 schematically shows a curtain in which the device according to FIGS. 1 and 2 has been applied;

FIG. 4 shows a side elevation of a hook, as provided around the device according to FIGS. 1 and 2;

FIG. 5 shows a connection between two oblong members according to a further embodiment of the invention;

FIGS. 6 and 7 show a suspension member;

FIG. 8 shows a further embodiment of the invention and

Figure 9:
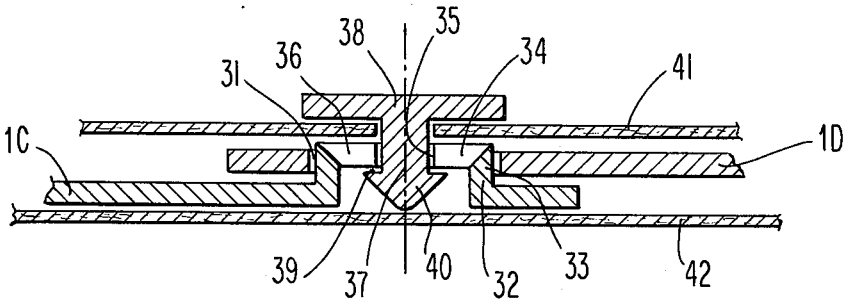

FIG. 9 shows a cross-section of a detail elucidating the embodiment of FIG. 8.

In FIG. 1 by 1 a zigzag shaped member is indicated, which consists of a strip having a height of a few centimeters. The strip has alternately straight portions 2 and bent portions 3. The bent portions extend over somewhat more than 180°, so that a zigzag shape is obtained the successive loops of which, near the transitions between the portions 2 and 3, are very near to or even in engagement with each other. Preferably, such a member terminates somewhat over half-way a straight portion 2.

FIG. 2 shows the same member as FIG. 1, but now in a more stretched position.

With one embodiment of the invention FIG. 1 shows the situation in which no force is acting on member 1 so that FIG. 2 shows the situation in which the ends of member 1 are pulled away from each other. With another embodiment FIG. 2 shows the position in which no force is exerted, whereas the shape of FIG. 2 occurs when the ends of the member 1 are pushed together. Both embodiments have practical value, depending on the circumstance whether the curtain should be without forces acting on it in the drawn back or in the drawn position.

In FIG. 3 in principle the suspension of a curtain, provided with a device according to the invention, has been shown. This device is in the position of FIG. 1 if no force acts on it. To a curtain rail or rod 4 a curtain 6 is mounted in the usual way, e.g. by means of runners 5, with in the upper hem 7 a member 1. In the shown position the curtain on the one hand is connected with a fixed point 8 and on the other hand at 9 to a cord 10, which via pulleys 11 and 12 is lead to a cordbrake or toggle 13.

By the shadow planes 14 the pleats of the curtain are indicated. The final pleat plane 15 only is half so broad as the pleat planes in the centre of the curtain. As appears from the co-operation between the pleats and the runners 5, a runner is each time mounted to the curtain at a location in the centre between two bent portions 3 of the resilient member 1, which is present in the hem 7. The attachment of the curtain to the runners 5 will be discussed below.

It is clear that in FIG. 3 the cordbrake or toggle 13 must be active to keep the curtain in the drawn position.

In case the device is of the type taking the position of FIG. 2 if no force acts on it, the cord 10 can be connected to the rightest hook 5 and be lead immediately to a pulley to the left of the curtain.

FIG. 4 shows a U-shaped hook 16, as can be applied with the present invention. Of the U-shaped hook the leg 17 at its upper end is reversed to the hook-shaped portion 18, which can be mounted in a runner 5. The other leg 19 at its free end 20 is reversed and can grip around leg 17. The resilient member 1 and the hem of curtain 6 are enclosed by the hook. Piercing the hooks through the curtain will generally not cause difficulties.

In FIG. 5 the ends are shown of two oblong members 1A and 1B, which are provided with holes 21. From each hole four slits 22 extend radially. The holes 21 are provided in the centre of each straight portion 2 between two bent portions 3 of the oblong member 1A or 1B. This has the advantage that the curtain is supported in its centre, so that it cannot hang aslant. Through said holes the mandrel 23 of a suspension member 24 can be inserted (FIGS. 6 and 7). The suspension member is at its upper side provided with a hook 25, which can be of any type suitable for mounting to known runners. When the oblong member is stretched or pushed together suspension members 24 pivot somewhat. Said limited pivot movement in general will not cause difficulties, in particular not when the hook 25, as shown at 26, has a sharp lower edge at least at that location where it is suspended to a runner 5.

Mandrel 23 has a shaft 28, which fits into a hole 21 and a somewhat thicker head 27, which bevels at the front side and at the rear side at 29 provides a shoulder.

By reason of the slits 22 the head 27 of a mandrel can be inserted through a hole 21 until the material around the shaft 28 snaps behind the shoulder 29. Said shoulder is, for clearity's sake, exaggeratedly shown in the drawing.

The oblong member needs not to have the same thickness everywhere. By varying its thickness in the bent portions 3 it is possible to control the rigidity and the straightness of the portions 2 between the bent portions 3 in the mechanically biased position (FIGS. 2 and 5).

By inserting a mandrel 23 through two holes 21, which lie over each other, as is shown at 30 in FIG. 5 the two oblong members 1A and 1B can be connected with each other.

FIG. 8 shows a further embodiment of the oblong member. At the left side two holes 31 are provided, whereas further embossments 32 are provided. Both the holes 31 and the embossments 32 are situated half-way a straight portion between two bent portions.

FIG. 9 shows a cross-section through an embossment 32 together with the curtain and a further oblong member as well as a suspension member. The embossment 32 is part of an oblong member 1C and has a skirt portion 33 and an upper face 34. In this face a hole 35 is provided, narrow slits 36 extending radially from said hole. A further oblong member 1D encompasses with one of its holes 31 the embossment 32.

A mandrel 37 of a suspension member 38 is inserted through hole 35. The lips of face 34 formed between the slits 36 snap behind a shoulder 39 of a head 40 provided at the end of the mandrel 37. The curtain at both sides of the hem in which the members 1C and 1D are inserted is indicated at 41 and 42. The suspension member 38 is of the type shown in FIGS. 6 and 7 with the difference that two mandrels are provided. Of course the same construction with the embossments 32 can be used with any number of embossments in a vertical row, provided the suspension member is adapted to this member.

When the oblong member shown in FIG. 8 has not been connected to a further oblong member the most left part can be eliminated by cutting the member along the line 43. In order to facilitate this it is possible to apply a notch or break line along line 43.

What is claimed is:

1. A device for making a curtain hang in regular pleats, said device capable of assuming two positions, the first position being prior to an elastic deformation of said device and the second position being after elastic deformation of said device, comprising:

an oblong bent shaped resilient member of a plastic material which is a zig-zag type shape such that it can be subjected to an elastic deformation from said first position into said second position and vise versa, said resilient member having a pre-determined total length measured along said zig-zagged shape portions and having two ends, wherein the linear distance between said ends of said resilient member is greater in said second position than in said first position, said linear distance in said second position being at least 50 percent of said total length of said resilient member;

connecting means provided at said ends of said resilient member for connecting said resilient member to another oblong bent shaped resilient member, said connecting means comprising a male connector located at one of said ends and a female connector at the other of said ends wherein said female connector includes an opening and said male connector comprises an embossment, which is provided with a central opening with slits extending radially from said central opening; and attaching means for connecting a hanger to said resilient member, said attaching means including a mandrel for engagement with said central opening of said embossment of said male connector, whereby said male connector provides connecting means for connecting said resilient member to another resilient member by inserting said male connector into said female connector and whereby said male connector of said resilient member also provides means for engagement with said mandrel of said attaching means to enable connection of a hanger at the point where said resilient members are connected.

2. A device for making a curtain hang in regular pleats as in claim 1, wherein a straight portion of said member is located between said zig-zagged portions and said connecting means is located at said ends of said member such that when two such members are connected at their respective ends that said connection means would be located at approximately half-way between said ends which forms a zig-zagged portion.

3. A device for making a curtain hang in regular pleats as in claim 2, wherein attaching means for connecting a hanger to said member are provided, said attaching means being located in said straight portions, half-way between said zig-zagged portions.

* * * * *